US007821155B2

(12) United States Patent
Reinsel et al.

(10) Patent No.: US 7,821,155 B2
(45) Date of Patent: Oct. 26, 2010

(54) POWER SUPPLY SYSTEMS FOR DISPENSERS AND METHODS OF POWERING DISPENSERS

(75) Inventors: Christopher M. Reinsel, Neenah, WI (US); Daniel J. Geddes, Appleton, WI (US); Brian S. Fontaine, Westerville, OH (US); Gary E. Myers, New Albany, OH (US)

(73) Assignee: Georgia-Pacific Consumer Products LP, Atlanta, GA (US)

( * ) Notice: Subject to any disclaimer, the term of this patent is extended or adjusted under 35 U.S.C. 154(b) by 265 days.

(21) Appl. No.: 11/779,563

(22) Filed: Jul. 18, 2007

(65) Prior Publication Data

US 2008/0018302 A1 Jan. 24, 2008

Related U.S. Application Data

(60) Provisional application No. 60/831,765, filed on Jul. 18, 2006.

(51) Int. Cl.
*H02J 1/10* (2006.01)
*H02J 3/38* (2006.01)
*H02J 9/00* (2006.01)

(52) U.S. Cl. ..... 307/23; 307/17

(58) Field of Classification Search ..... 307/23, 307/17; 242/554, 564.4, 563
See application file for complete search history.

(56) References Cited

U.S. PATENT DOCUMENTS 5,060,323 A 10/1991 Shaw
5,397,028 A 3/1995 Jesadanont
5,458,122 A 10/1995 Hethuin
5,483,437 A 1/1996 Tang
5,570,869 A 11/1996 Diaz et al.
5,789,828 A 8/1998 Tremaine et al.
5,906,506 A 5/1999 Chang et al.
6,038,519 A 3/2000 Gauthier et al.
6,069,354 A 5/2000 Alfano et al.

(Continued)

FOREIGN PATENT DOCUMENTS

WO 2006060047 A1 6/2006

OTHER PUBLICATIONS

International Search Report and Written Opinion of the International Searching Authority for PCT/US2007/073779, mail date Mar. 14, 2008.

(Continued)

*Primary Examiner*—Jared J Fureman
*Assistant Examiner*—Carlos Amaya
(74) *Attorney, Agent, or Firm*—Joel T. Charlton

(57) ABSTRACT

In one embodiment, a power system for a plurality of dispensers comprises an AC transformer to receive a line voltage and generate an output voltage of about 2 volts AC to about 50 volts AC; a plurality of dispensers, each housing at least one electrical component operatively configured to dispense product through a dispensing aperture, each of the dispensers comprising a battery compartment; and a plurality of power converters adapted to be at least partially disposed within the battery compartments such that at least one power converter is associated with each dispenser, the converters disposed in communication with the AC transformer such that the power converters receive the output voltage and provide a DC voltage to one or more electrical components housed within the dispensers.

22 Claims, 11 Drawing Sheets

U.S. PATENT DOCUMENTS

| | | | | |
|---|---|---|---|---|
| 6,243,276 | B1 | 6/2001 | Neumann | |
| 6,293,486 | B1 | 9/2001 | Byrd et al. | |
| 6,296,065 | B1 | 10/2001 | Carrier | |
| 6,431,189 | B1 | 8/2002 | Deibert | |
| 6,497,345 | B1 | 12/2002 | Wilker et al. | |
| 6,592,067 | B2 | 7/2003 | Denen et al. | |
| 6,695,246 | B1 | 2/2004 | Elliott et al. | |
| 6,705,534 | B1 | 3/2004 | Mueller | |
| 6,793,170 | B2 | 9/2004 | Denen et al. | |
| 6,838,887 | B2 | 1/2005 | Denen et al. | |
| 6,853,292 | B1 * | 2/2005 | Kramer et al. | 340/3.43 |
| 6,871,815 | B2 | 3/2005 | Moody et al. | |
| 6,994,408 | B1 | 2/2006 | Bunnell | |
| 7,017,856 | B2 | 3/2006 | Moody et al. | |
| 7,040,566 | B1 | 5/2006 | Rodrian et al. | |
| 7,102,366 | B2 | 9/2006 | Denen et al. | |
| 7,161,359 | B2 | 1/2007 | Denen et al. | |
| 7,182,288 | B2 | 2/2007 | Denen et al. | |
| 7,182,289 | B2 | 2/2007 | Moody et al. | |
| 7,370,824 | B1 * | 5/2008 | Osborne | 242/563 |
| 2004/0178297 | A1 | 9/2004 | Moody et al. | |
| 2004/0257656 | A1 | 12/2004 | Sellgren et al. | |
| 2005/0072874 | A1 | 4/2005 | Denen et al. | |
| 2005/0072875 | A1 | 4/2005 | Granger et al. | |
| 2006/0169827 | A1 | 8/2006 | Lewis et al. | |

OTHER PUBLICATIONS

Ballard Smith, Series 800 Automatic Paper Towel Dispenser User Manual, Publication date unknown.

* cited by examiner

POWER SUPPLY SYSTEMS FOR DISPENSERS AND METHODS OF POWERING DISPENSERS

CROSS REFERENCE TO RELATED APPLICATIONS

This patent application claims the benefit of U.S. Provisional Patent Application No. 60/831,765 filed Jul. 18, 2006, and entitled "Power Supply System For Dispenser," which is incorporated by reference in its entirety.

BACKGROUND

The present disclosure generally relates to power supply systems, and more particularly, to power supply systems and methods to provide power to one or more dispensers.

Battery powered paper dispensers incorporating waste minimizing technology have become popular for minimizing waste, while improving sanitation and convenience of use. For battery powered paper dispensers, periodic battery replacement often becomes a nuisance. Indeed, monitoring power levels within batteries in use as well as replacing spent batteries can require important employee time that may be spent on other important job-related tasks.

FIG. 1 illustrates a paper dispenser with a conventional battery pack BP, including batteries 58, as disclosed in U.S. Pat. No. 6,592,067. Batteries 58 within battery pack BP can be changed during a maintenance procedure. This procedure typically includes opening a dispenser housing to access and remove batteries (58) with battery pack BP for replacement or testing.

Battery testing is generally utilized to determine when batteries are nearing end of life (EOL). Sometimes, batteries within battery pack BP are replaced prior to EOL during a scheduled battery replacement. While replacing batteries nearing EOL may be efficient, this procedure can lead to replacing batteries having remaining power amounts thereby potentially wasting good batteries, increasing battery costs, and increasing battery waste. In a similar vein, replacing batteries that are spent typically occurs after batteries have been drained for some time thereby causing a dispenser to be inoperable for some amount of time.

For an array of dispensers within a location, for example, one or more restrooms, dispensers seeing more frequent use relative to others require more frequent battery replacement. It is typically a nuisance to keep battery replacement records, particularly in multi-dispenser environments. In addition, battery acquisition costs and disposal concerns, and the requirement of additional labor costs are significant limitations of current battery powered paper dispensers.

Accordingly, there is a need for improved power systems for dispensers to resolve the above-discussed and other difficulties and limitations.

BRIEF SUMMARY

Disclosed herein are power supply systems for dispensers and methods of powering dispensers.

In one embodiment, a power system for a plurality of dispensers comprises an AC transformer to receive a line voltage and generate an output voltage of about 2 volts AC to about 50 volts AC; a plurality of dispensers, each housing at least one electrical component operatively configured to dispense product through a dispensing aperture, each of the dispensers comprising a battery compartment; and a plurality of power converters adapted to be at least partially disposed within the battery compartments such that at least one power converter is associated with each dispenser, the converters disposed in communication with the AC transformer such that the power converters receive the output voltage and provide a DC voltage to one or more electrical components housed within the dispensers.

In one embodiment, a power system for a plurality of paper dispensers comprises an AC-to-AC transformer to receive an input AC voltage at a first voltage level and to provide an output AC voltage at a second voltage level; a plurality of paper dispensers, each having a dispense roller powered by a roller motor, the roller motor being a DC motor; a plurality of low voltage lines to carry the output AC voltage to the paper dispensers; and at least one AC-to-DC voltage converter disposed proximate one of the plurality of paper dispensers and coupled to at least one of the low voltage lines to receive the second voltage level, the at least one AC-to-DC voltage converter operatively configured to convert the output AC voltage to an output DC voltage.

In one embodiment, a dispenser comprises a dispenser housing having an inner chamber operatively configured to support a roll of paper and having a dispensing aperture; a DC motor operatively configured to dispense paper from the roll of paper through the dispensing aperture; a battery compartment adapted to receive a plurality of batteries; and a power converter sized to dispose at least partially within the battery compartment, the power converter comprising an input terminal receiving an AC voltage of between 2 and 50 volts, an output terminal providing a DC voltage to the motor; and a converter circuit disposed between the input and output terminals.

In one embodiment, a method to provide power to a plurality of dispensers, the method comprises providing a transformer operatively configured to receive an input voltage and to provide a supply voltage; and providing a voltage converter to receive the supply voltage and to provide an output voltage, the output voltage being provided to a dispenser to power the dispenser for dispensing operation and the voltage converter to have a predetermined size such that the voltage converter can be removably disposed within a compartment housed within the dispenser.

The above described and other features are exemplified by the following Figures and detailed description.

BRIEF DESCRIPTION OF THE DRAWINGS

Various embodiments of the invention can be better understood with reference to the following drawings. The components in the drawings are not necessarily to scale, emphasis instead being placed upon clearly illustrating the principles of the various embodiments of the present invention.

DETAILED DESCRIPTION

Figure 1:
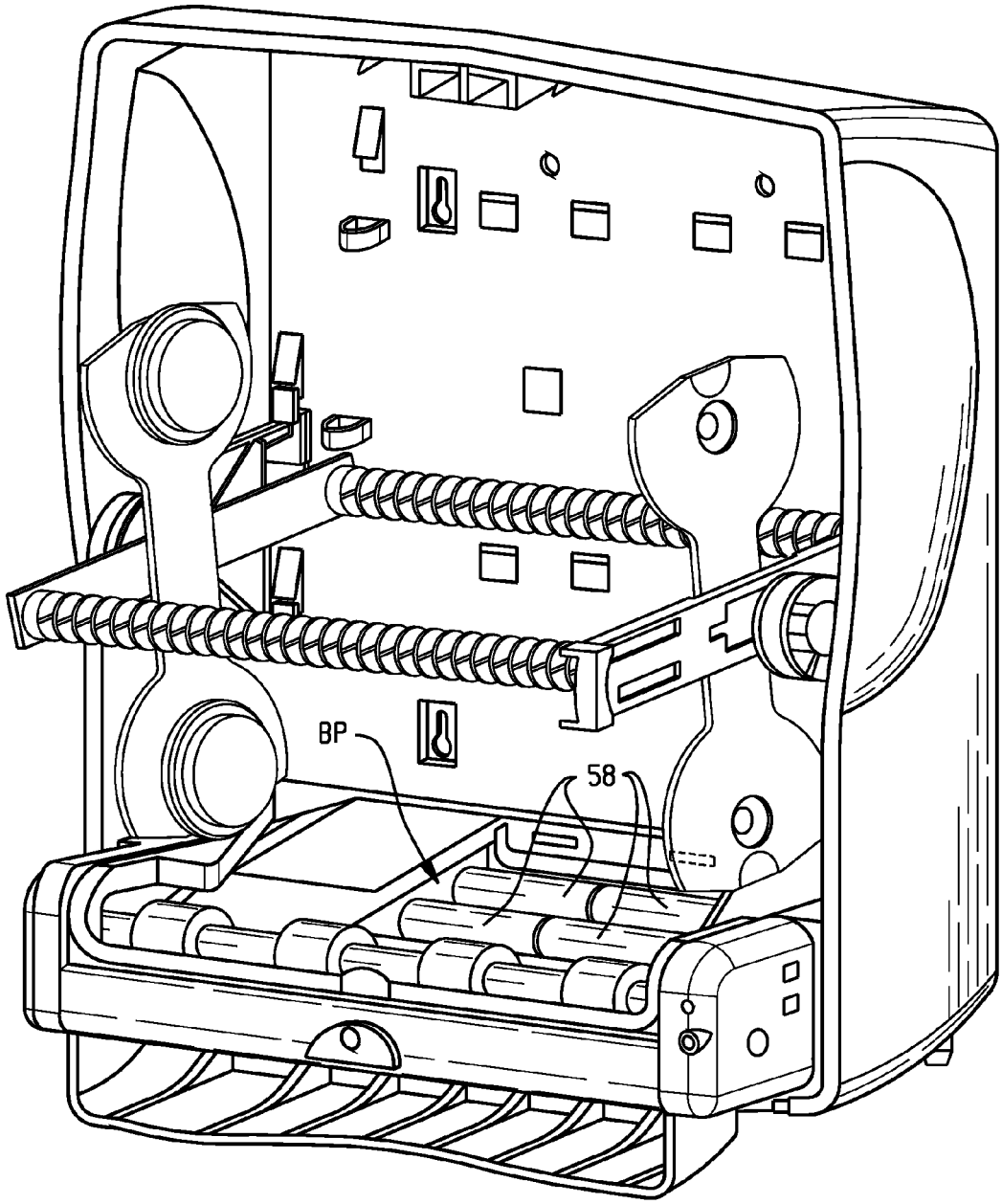
Fig. 1 PRIOR ART
FIG. 1 illustrates a conventional battery-powered dispenser that includes a battery compartment housing batteries.

The various embodiments of the present invention are directed to power supply systems and methods for one or more dispensers. Embodiments of the present invention may be used in conjunction with available battery-powered paper dispensers and/or new line-powered paper dispensers. In addition, embodiments of the present invention can be used to implement a network of dispensers in a location. Such locations can include, for example, an office, school, restaurant, or many other facilities where dispensers are desired.

Referring now to the figures, wherein like reference numerals represent like parts throughout the several views, exemplary embodiments of the present invention are described below in detail. Throughout this description, various components may be identified as having specific values or parameters, however, these items are provided as exemplary embodiments. Such exemplary embodiments do not limit the various aspects and concepts of the present invention as many comparable parameters, sizes, ranges, and/or values may be implemented.

Figure 2:
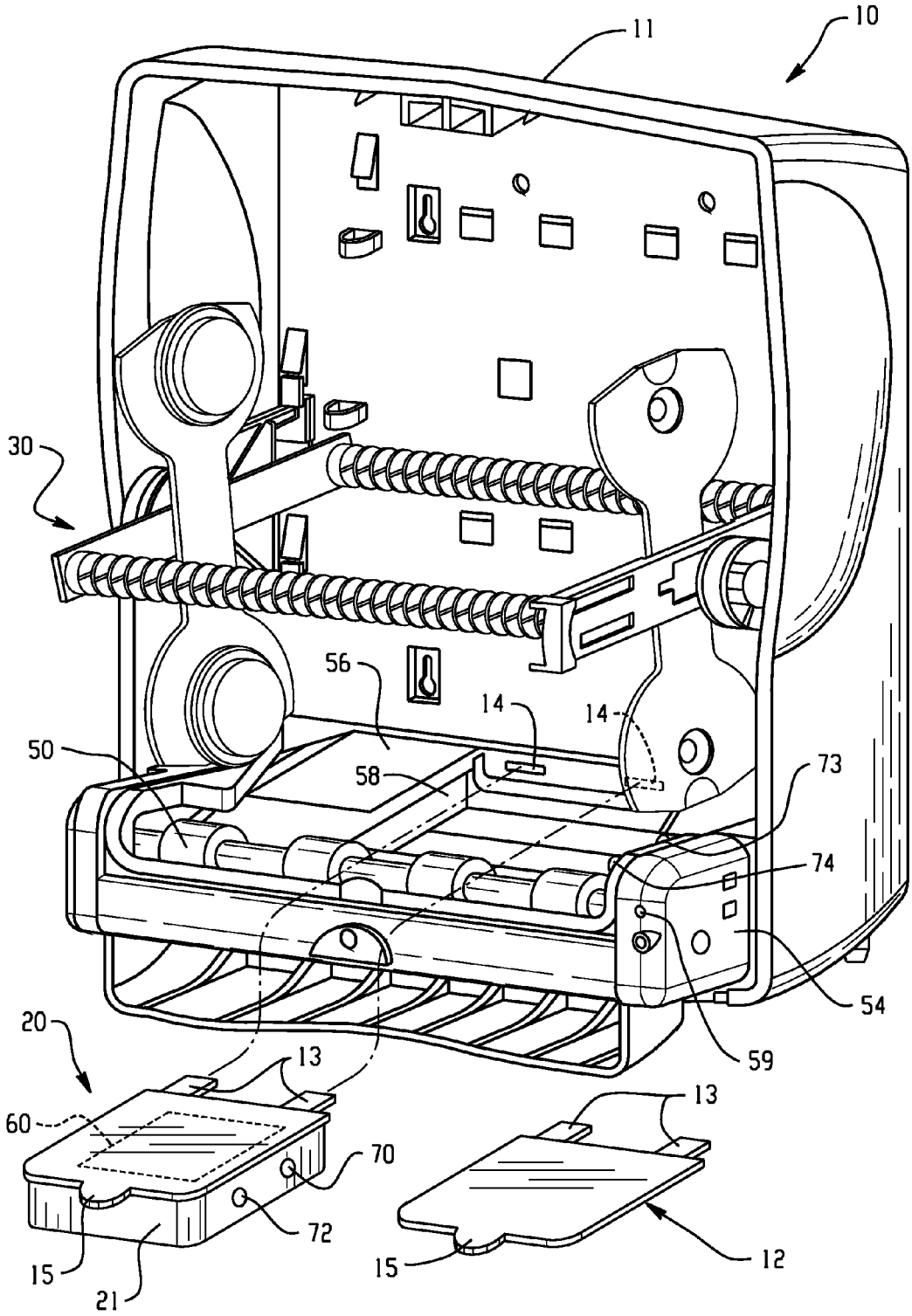
FIG. 2 illustrates a perspective view of an embodiment of a dispenser used with a power supply system in accordance with some embodiments of the present invention.
Figure 3:
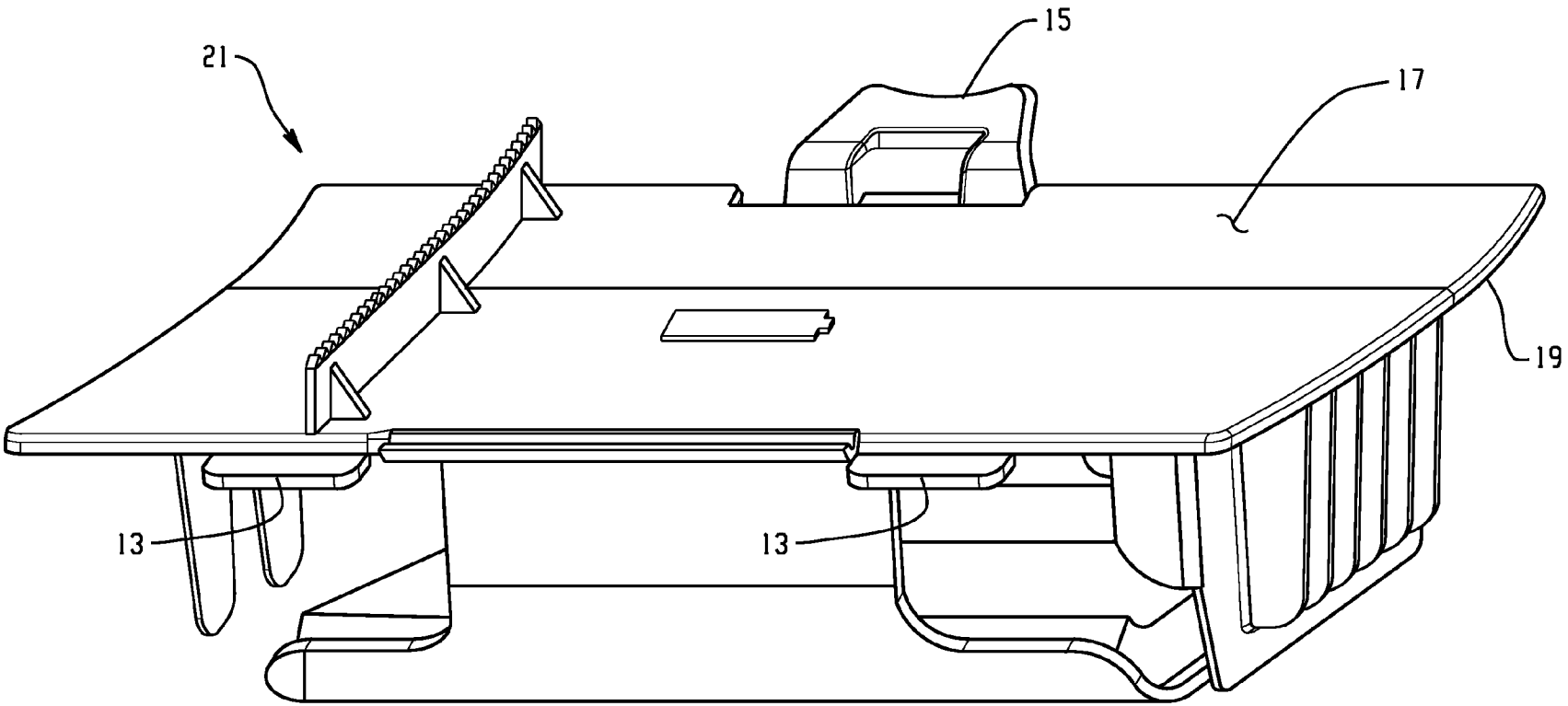
FIGS. 3-6 illustrate several perspective views of an adapter housing suitable for use with a dispenser in accordance with some embodiments of the present invention.
Figure 4:
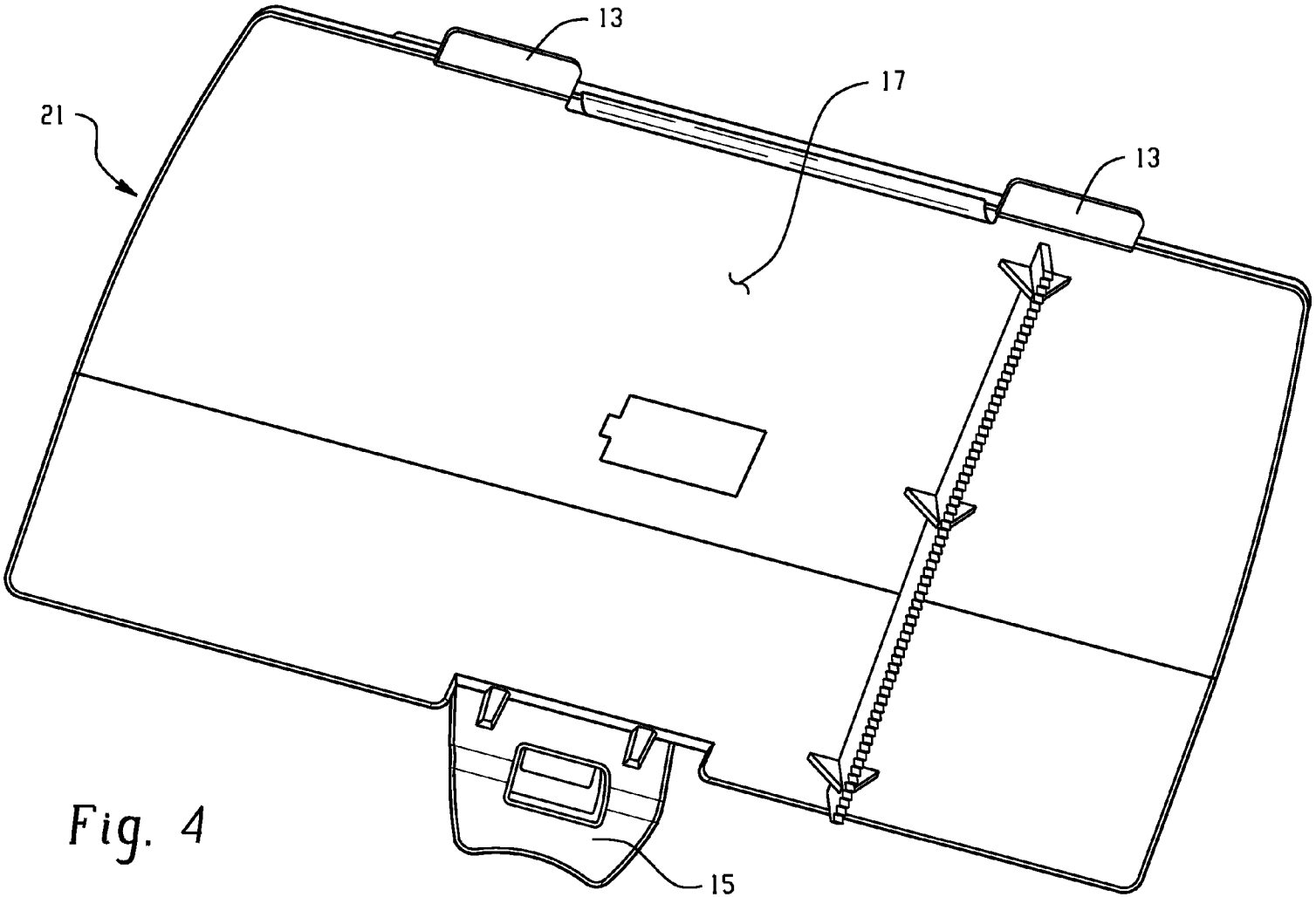
Figure 5:
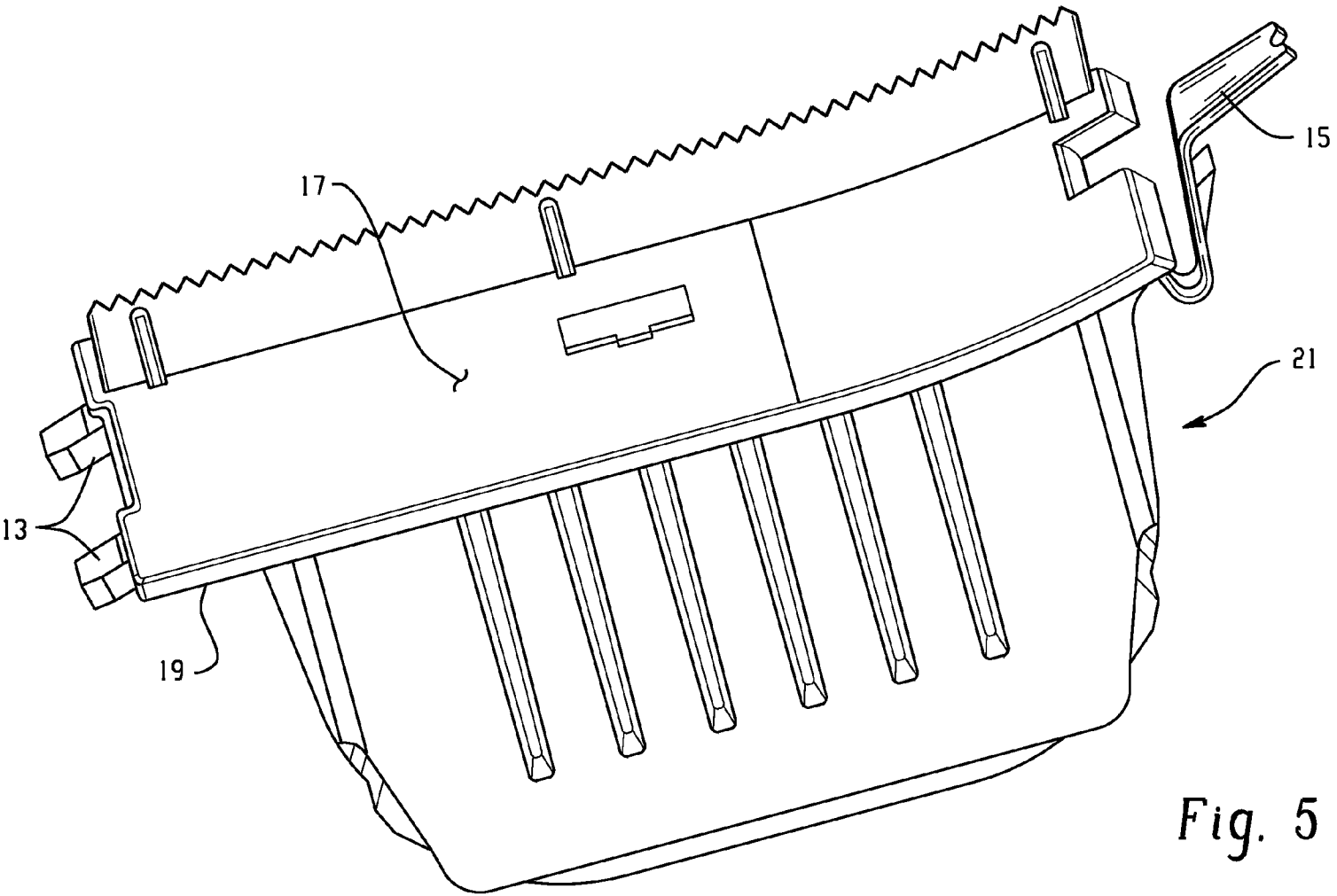
Figure 6:
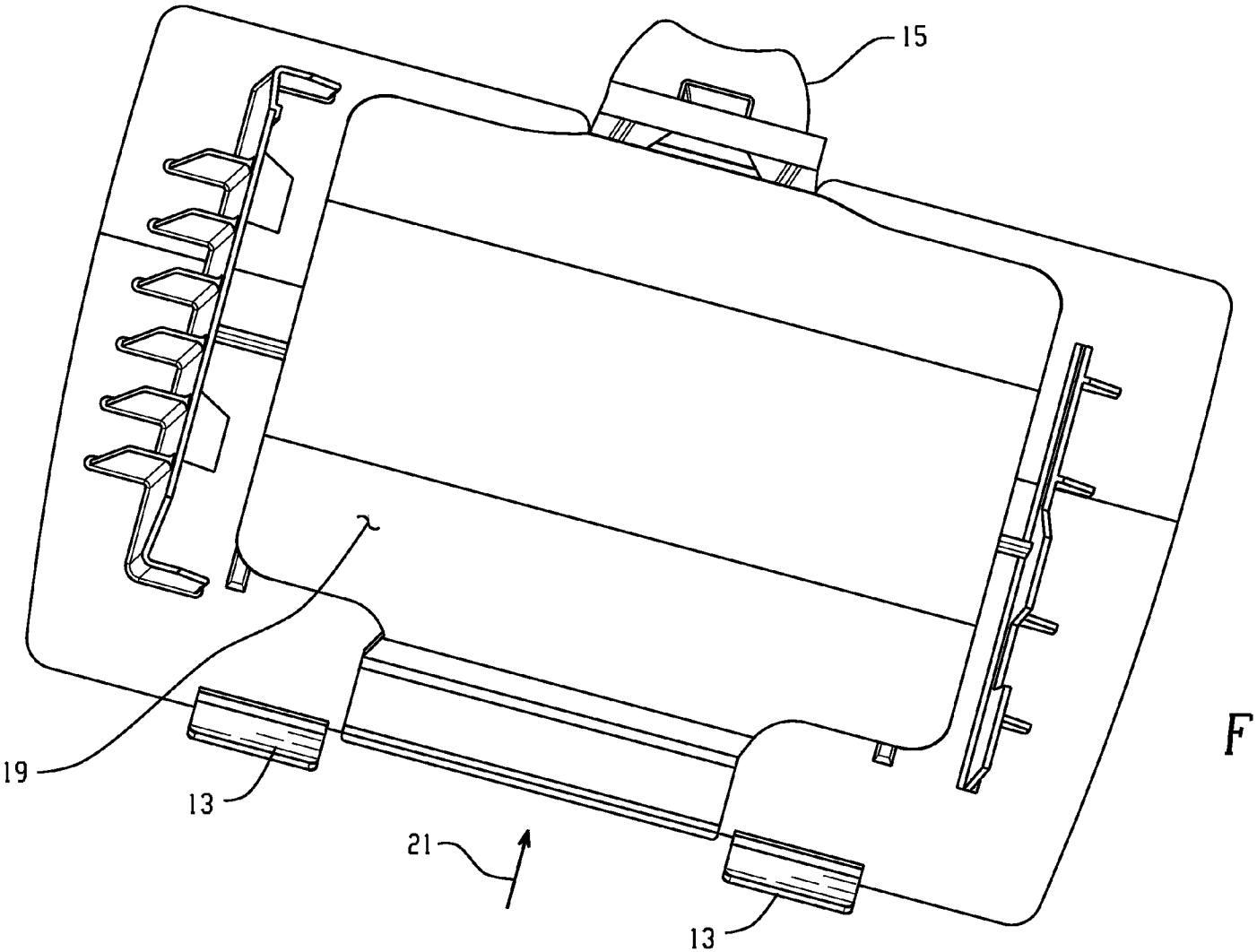

Referring now to FIG. 2, this figure illustrates a perspective view of an embodiment of a dispenser 10 that can be used with a power supply system according to some embodiments of the present invention. Other sample and possible dispensers are disclosed in U.S. Pat. Nos. 6,793,170 and 6,592,067 and US Patent Application Publication 2005/0072875, each of which are incorporated herein by reference. In addition, the dispenser 10 may be automated or user operated according to embodiments of the present invention. For example, the dispenser 10 may be operated in a hands-free mode by use of a proximity sensor, infrared sensor, capacitive-sensor, optical sensor, and many other sensors. According to other embodiments, the dispenser 10 may also respond to active input from a user to operate by dispensing material when receiving active input from a user. It is an advantage of some embodiments of the present invention to provide an AC-to-DC (Alternating Current to Direct Current) adapter system that can be implemented with existing battery powered paper dispensers.

It should be understood that the dispenser 10 can be used to dispense many types of materials in accordance with the various embodiments of the present invention. For example, the dispenser 10 may be configured to dispense sheet product material. The term "sheet products" can include natural and/or synthetic cloth or paper sheets. Further, sheet products can include both woven and non-woven articles. Examples of sheet products include, but are not limited to, wipers, napkins, tissues, and towels. Other possible types of dispensed materials can include, but are not limited to, plastic or plastic-based sheet materials and metallic or metallic-sheet materials. In addition, the dispenser may be adapted to emit various scents or scented air. As an example, this may include dispensing various fragrances to control area odors or alter scent characteristics of an area. In yet other embodiments, the dispenser may be adapted for dispensing liquids or foams (e.g., for use as a liquid or foam soap dispenser).

As shown in FIG. 2, dispenser 10 includes a rear housing 11 and a front housing (removed to expose dispenser components) that house dispenser components. The dispenser 10 can include a carousel assembly 30 and a feed roller 50 which serves to feed material to be dispensed by the dispenser 10. A control unit 54 can operate a feed roller motor 56. Power can be supplied to the dispenser 10 by batteries (not shown) or a system including an AC-to-DC adapter 20 as described below in more detail. A light 59, for example, a light-emitting diode (LED), may also be incorporated into a low battery warning system such that the light 59 turns on when battery voltage approaches or falls below a predetermined threshold.

Batteries or adapter 20 can be held within a compartment 58. The compartment 58 may be specifically designed to hold multiple batteries or may be specifically designed to hold the adapter 20. When batteries are used, a battery compartment cover 12 can retain one or more batteries within the compartment 58. The cover 12 can include a pair of tabs 13 sized to engage a pair of slot openings 14 within the dispenser housing. The cover 12 can further include a latch 15 adapted to engage a portion of the dispenser or dispenser housing to secure cover 12. Battery replacement can include engaging latch 15 to gain access to battery compartment 58. For brevity, the other enumerated items of FIG. 2 are not discussed here in detail; however, these components are discussed in detail in U.S. Pat. No. 6,592,067 (which is incorporated herein by reference in its entirety) with reference to FIG. 1.

As mentioned above, the adapter 20 can be used to provide power to the dispenser 10. According to some embodiments, the adapter 20 can include AC-to-DC voltage conversion circuitry 60 (discussed below in more detail with reference to FIG. 8). In one embodiment, the adapter 20 is supplied with a low AC voltage, e.g., about 2 VAC (volts alternating current) to about 50 VAC, specifically about 12 VAC to 30 VAC for some embodiments, with 24 VAC particularly useful for some embodiments, and converts the low AC voltage to a low DC voltage, e.g., about 2 VDC (volts direct current) to about 24 VDC, specifically about 2 VDC to about 12 VDC for some embodiments, with 6 VDC particularly useful for some embodiments. As the adapter 20 can be sized to take the place of batteries or sized the same as a few batteries, the adapter 20 can be disposed in contact with battery electrical connections (not shown). Advantageously, embodiments of the present invention can retrofit an existing dispenser to be powered as discussed herein. Retrofitting need not alter an existing dispenser, thus enabling existing dispensers the option of still being powered by batteries.

Battery electrical connectors 73, 74 are configured for electrical contact with batteries to receive power from batteries. The adapter 20 can have corresponding connectors 70, 72 to connect to the battery electrical connections. The exact location of connectors 70, 72 can vary according to different embodiments. In one embodiment, however, the adapter's 20 connectors 70, 72 mirror the connectors 73, 74 of the dispenser 10 to form electrical connections thereby enabling the adapter 20 to provide power to the dispenser 10. It should be understood, that in those embodiments where the compartment 58 is not sized specifically for batteries, the adapter 20 also has connectors 70, 72 to be coupled to the dispenser 10 to provide electrical power to the dispenser 10.

As mentioned above, the adapter 20 can be housed within an adapter housing 21 when disposed within the dispenser 10. As an example, the adapter housing 21 may be used when the compartment 58 is specifically configured to receive batteries. Thus, the adapter housing 21 can alter or retrofit sizing of the compartment 58 to receive the adapter 20. Advantageously, this enables the adapter 20 to fit snugly and ensures that the adapter 20 is positioned in a desired position within the dispenser 10.

FIGS. 2-6 illustrate the adapter housing 21 suitable for use with the dispenser 10 according to some embodiments of the present invention. The adapter housing 21 can be sized to be received into the compartment 58. The shape and size of the adapter housing 21 can vary according to application as one advantage of the adapter housing 21 is to enable the adapter 20 to mate with the dispenser 10. As shown, the adapter housing 21 can include a top surface 17, a lower surface 19, and pair of tabs 13. The pair of tabs 13 can be sized to engage a pair of corresponding slot openings 14 of the dispenser 10. The adapter housing 21 can further include the latch 15 adapted to engage a structure within a housing of the dispenser. The shape of the adapter 20 and the adapter housing 21 can correspond to enable quick entry and removal of the adapter 20 within the dispenser 10 should a user desire to insert or remove the adapter 20 from the dispenser 10. In some embodiments, the adapter housing 21 may not be desired or used.

Figure 7:
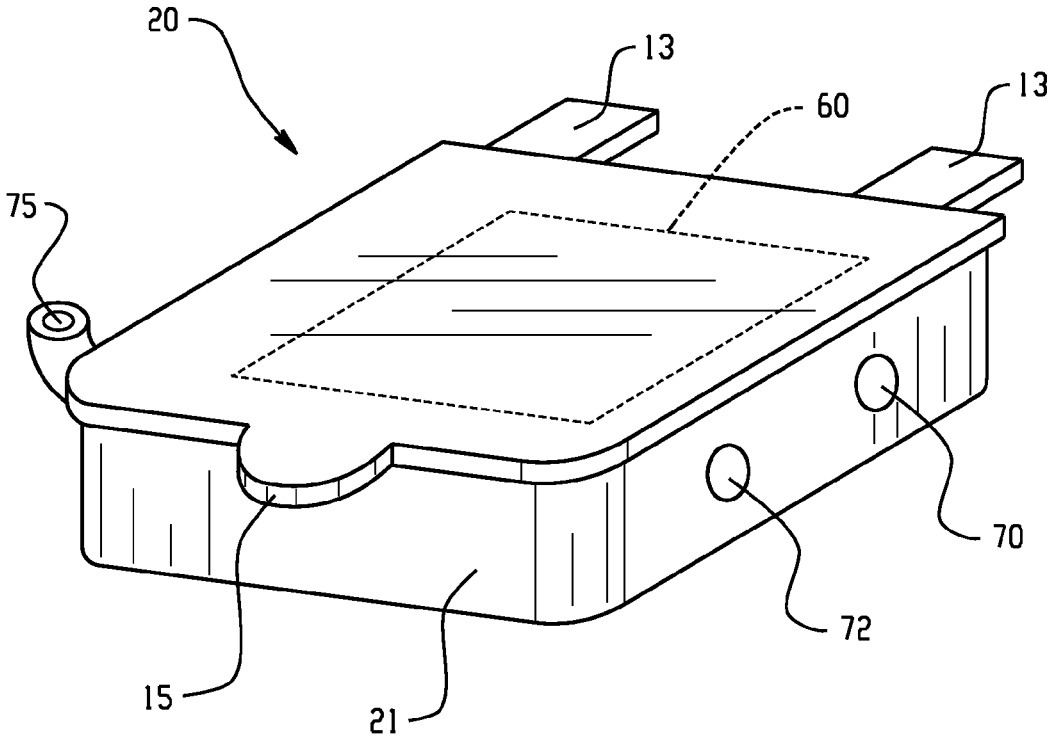
FIG. 7 illustrates an exemplary adapter for use with a dispenser in accordance with some embodiments of the present invention.

FIG. 7 (with periodic reference to FIG. 2) illustrates an exemplary adapter 20 for use with the dispenser 10 in accordance with some embodiments of the present invention. As mentioned herein, the adapter 20 comprises a plurality of inputs and outputs to receive one voltage and provide another. The adapter 20 can receive an input AC voltage and provides an output DC voltage. To accomplish voltage transition, the adapter 20 can comprise the AC-to-DC voltage conversion circuitry 60. The AC-to-DC voltage conversion circuitry 60 can be configured to convert an AC voltage to a DC voltage and, in some embodiments, the AC-to-DC voltage conversion circuitry 60 may convert an input voltage to a lower voltage (e.g., a DC/DC converter). In other embodiments, the adapter 20 may also provide multiple output voltages (AC or DC) having different voltage levels so that the adapter 20 can provide different voltages to dispenser 10 components operating at different voltage levels.

The inputs and outputs of the adapter 20 can serve as interfaces with other dispenser 10 components. As such, the inputs and outputs can be positioned in various configurations and include many different interfacing mechanisms. As illustrated, the adapter 20 has an input 75 and two connectors 70, 72. The connectors 70, 72 can be spaced in relation to corresponding electronic contacts within the compartment 58. As an example, the distance between connectors 70, 72 can approximate a battery diameter. This advantageous configuration enables the connectors 70, 72 to provide electrical coupling between AC-to-DC voltage conversion circuitry 60 and the electrical components of the dispenser 10, such as the feed roller motor 56 and other dispenser electronics. The connectors 70, 72 can be many types of electrically conducting items, including for example, springs, contacts, or outwardly extending metal arms. Alternatively, the connectors 70, 72 can be configured to connect to a wire (e.g., a jumper wire) extending between the adapter 20 and the dispenser 10.

The input 75 of the adapter 20 enables the adapter 20 be electrically connected to an input voltage supply. Indeed, a low voltage AC line 76, i.e., supply line, (FIG. 8) can be connected at one end to a terminal which can be coupled with a barrel jack as the input 75 to AC-to-DC voltage conversion circuitry 60. The low voltage AC line 76 can be a low voltage line, with the AC voltage being supplied by a step down transformer. Advantageously, low voltage transformers are commonly commercially available. For example the step down transformer can be a 120 VAC to 24 VAC wall-mount or box-mount transformer. In some embodiments, the low voltage AC line 76 is provided at approximately 24 VAC. This advantageous feature enables safe installations and maintenance to be performed by maintenance personnel who are not highly skilled tradesman, e.g., licensed electricians and electrical contractors. Moreover, this advantageous feature can reduce associated installation and maintenance costs and provide a safe dispenser.

Figure 8:
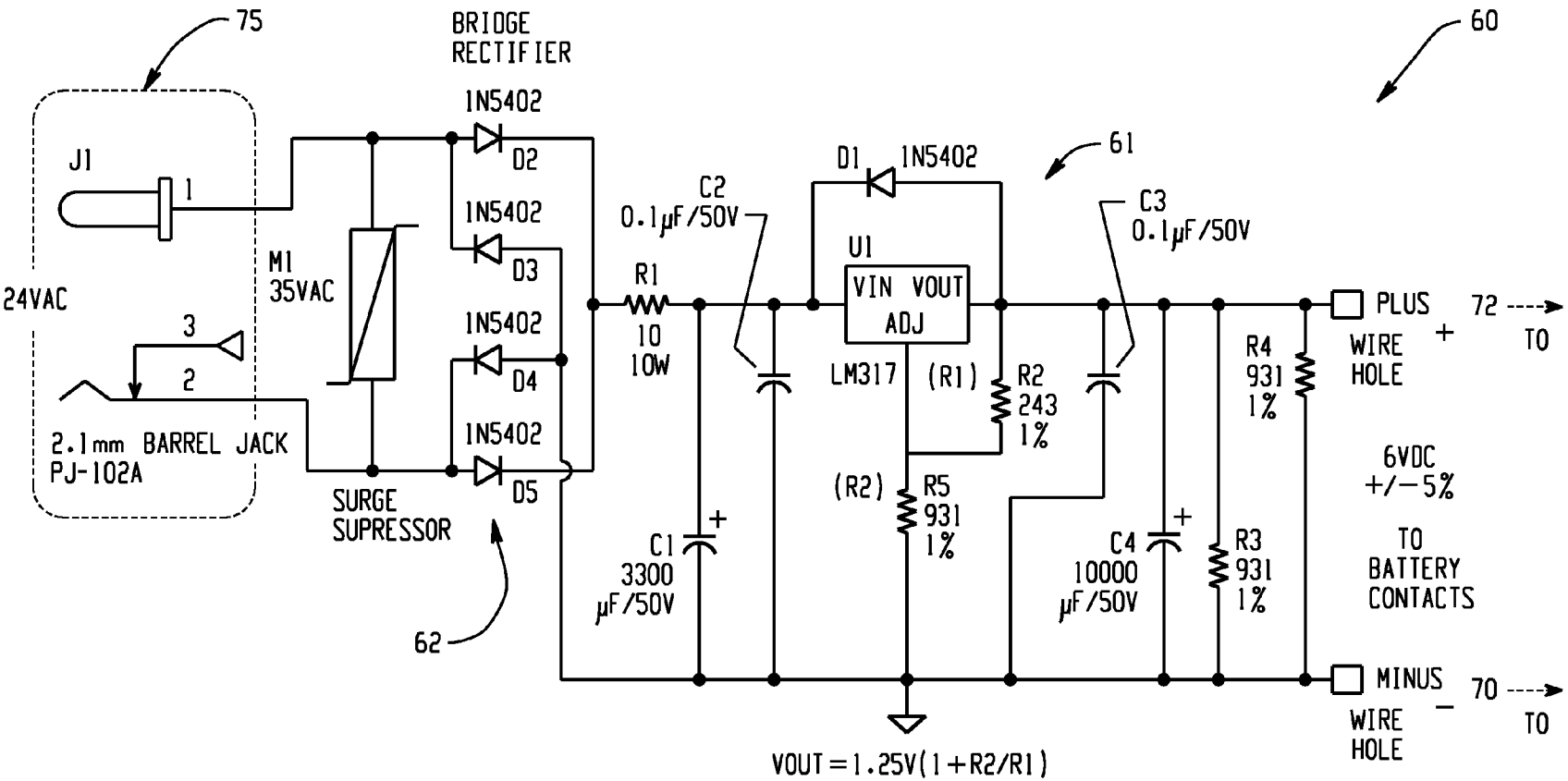
FIG. 8 illustrates a schematic diagram of an AC-to-DC voltage conversion circuit for use in accordance with some embodiments of the present invention.

FIG. 8 (with periodic reference to FIG. 2) illustrates a schematic diagram of the AC-to-DC conversion circuitry 60 for use in accordance with some embodiments of the present invention. It should be understood that AC-to-DC voltage conversion circuitry 60 is an exemplary conversion circuit and that many others can be used in alternative embodiments. As shown, the AC-to-DC voltage conversion circuitry 60 generally includes a bridge rectifier circuit 62 and additional signal conditioning circuitry 61. In one embodiment, the signal conditioning circuitry 61 comprises adequate filtering capabilities so that the AC-to-DC voltage conversion circuitry 60 can power various electronic sensors with power yet not affect operational characteristics of any used sensors. For example, the signal conditioning circuitry 61 can provide a steady, filtered DC voltage that would not affect the operation of a proximity sensor (not shown) used in operating the dispenser 10.

FIG. 8 also illustrates a plurality of inputs and outputs of the AC-to-DC voltage conversion circuitry 60 as discussed above. Indeed, FIG. 8 shows that AC-to-DC voltage conversion circuitry 60 includes connectors 70, 72 that provide a DC voltage to power dispenser feed roller motor 56, and that AC-to-DC voltage conversion circuitry 60 includes the input 75. The input voltage terminal can be an input barrel jack for electrical coupling to voltage line that can be supplied by a transformer. A barrel jack connection mechanism advantageously enables the AC-to-DC voltage conversion circuitry 60 to be separated relative to dispenser 10, such as during adapter 20 installation or replacement. It should be understood that the input 75 can be many types of connection mechanisms in accordance with the various embodiments of the present invention.

Figure 9:
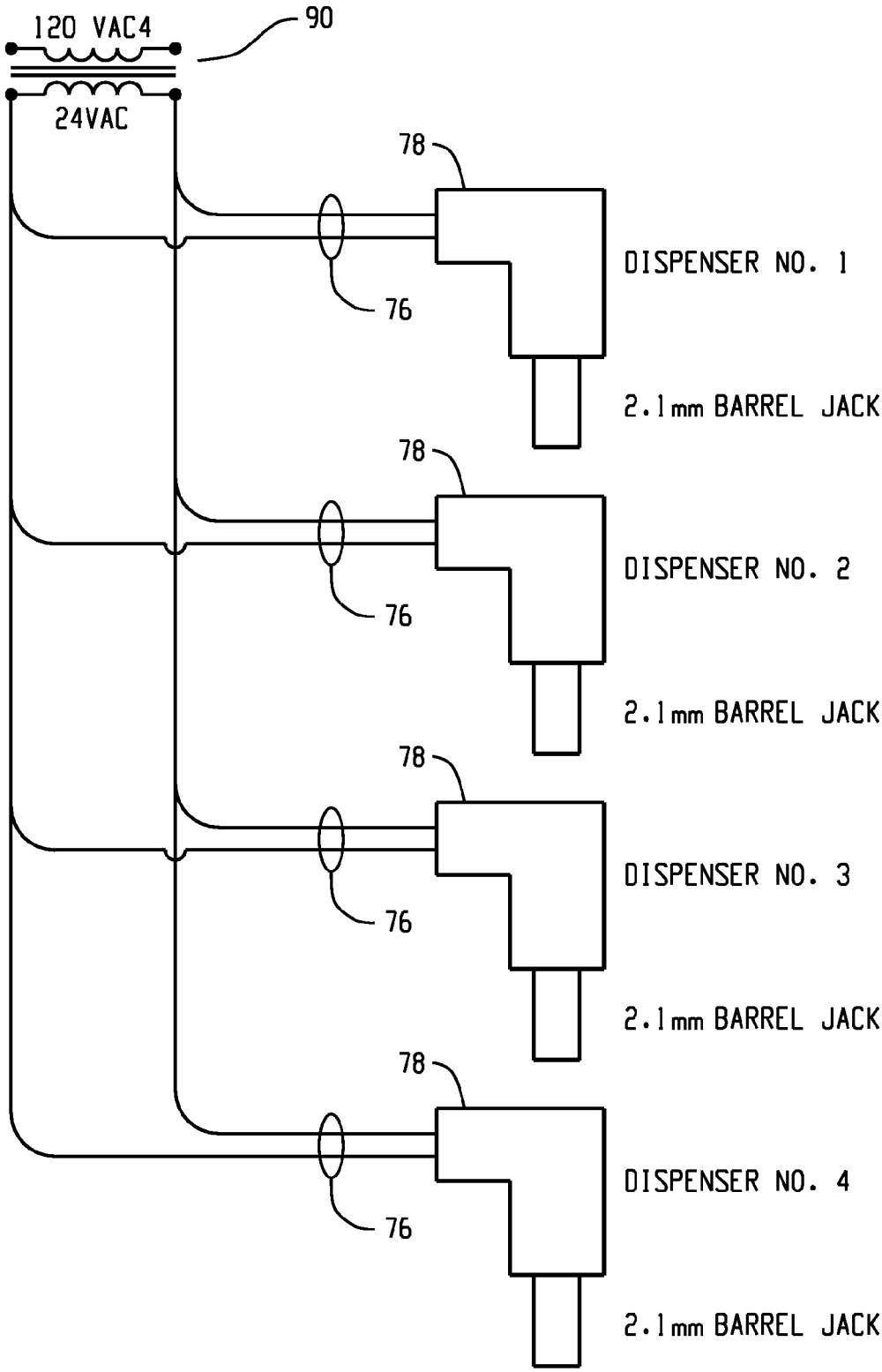
FIG. 9 illustrates a wiring diagram for a power system for one or more dispensers in accordance with some embodiments of the present invention.

FIG. 9 (with periodic reference to FIG. 2) illustrates a wiring diagram for a power system for one or more dispensers in accordance to some embodiments of the present invention. The wiring diagram generally illustrates a transformer 90 providing power to multiple low voltage AC lines 76 that terminate in connection points 78. As shown, the connection points can be male-type barrel jack connectors. Thus, the illustrated wiring diagram shows that the single transformer 90 can provide electrical power to a plurality of dispensers 10 (not shown) by connecting the connection points 78 to one or more dispensers 10. The connection points 78 can provide power to an input of the adapter 20.

In one embodiment, the transformer 90 receives a standard 120 VAC input and steps down this input voltage to a lower AC voltage (e.g., 24 VAC). In some embodiments, the line voltage can be about 110 VAC to about 230 VAC. Stepping down the voltage to a lower level enables an efficient yet effective power distribution network to one or more dispensers. Indeed, the transformer 90 can be located remote from (e.g., in a different room) one or more of the dispensers. Advantageously, having a remotely located transformer 90 can provide a centrally located power supply to feed multiple dispensers according to some embodiments. Further, due to the use of a low voltage AC power feed systems, distances between the transformer 90 and dispensers can range widely (e.g., less than 1 foot up to approximately 1000 feet). This advantageously enables the low voltage AC line 76 to be sized specifically according to installation requirements.

Other wiring configurations are also possible in accordance with embodiments of the present invention. For example, the connection points 78 of FIGS. 9-10 may supply power to multiple dispensers such that a dedicated supply line is not required for one dispenser. Indeed, two dispensers may be coupled together with a short connection line so that one connection point 78 can provide power to multiple dispensers. This configuration can aid in reducing low voltage AC line 76 lengths to reduce installation and product costs.

Figure 10:
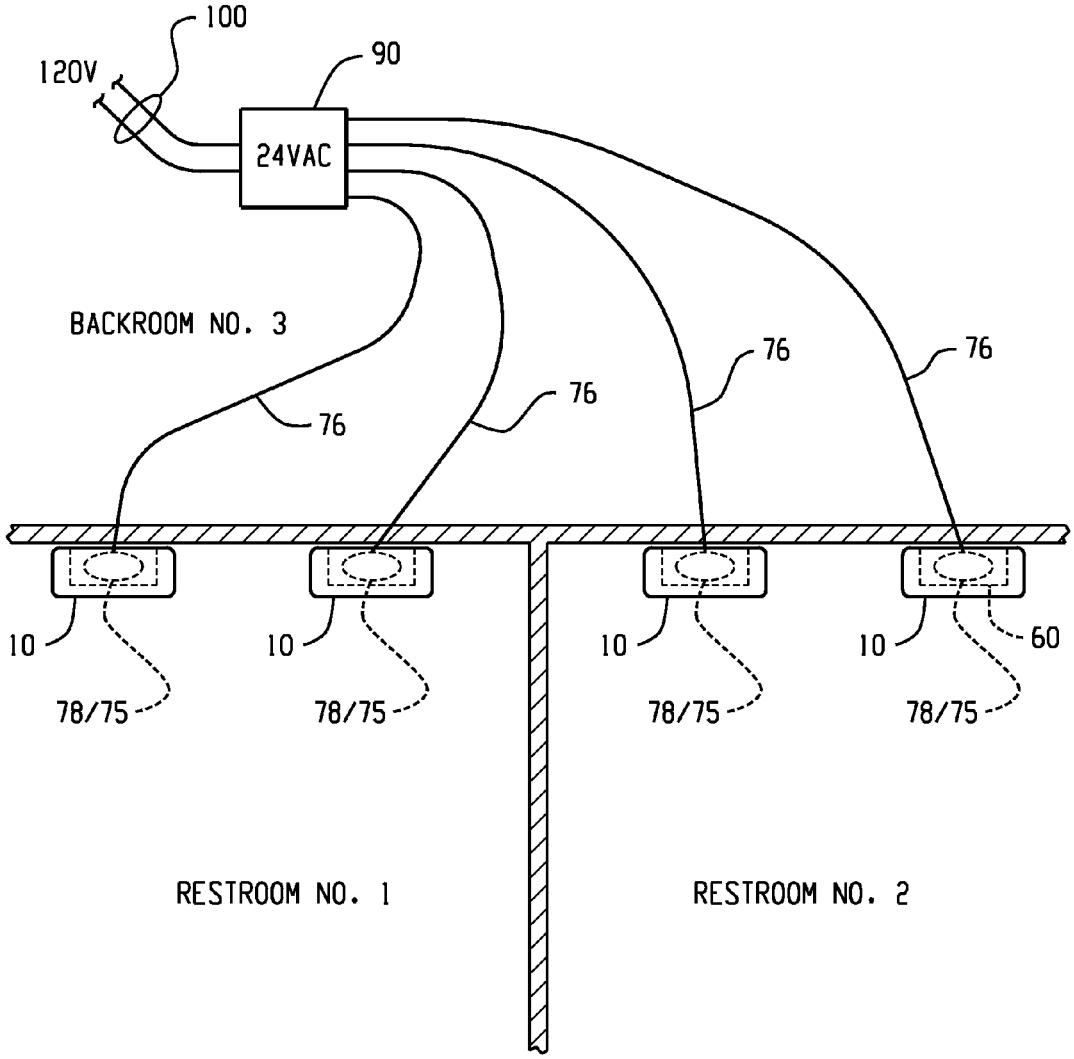
FIG. 10 illustrates a power supply system wiring network for one or more dispensers of a dispenser network in accordance with some embodiments of the present invention.

FIG. 10 (with periodic reference to FIG. 2) illustrates a power supply system network for one or more dispensers of a dispenser network in accordance with some embodiments of the present invention. More specifically, FIG. 10 illustrates how multiple dispensers in distinct locations (e.g., separate restrooms) can be powered. The dispensers 10 illustrated in FIG. 10 can include the dispensers 10 discussed so that dispensers house adapters 20 with AC-to-DC voltage conversion circuitry 60.

The power supply system network generally includes an input voltage supply, the transformer 90, multiple low voltage AC lines 76, and several dispensers 10. The transformer 90 may be located remotely from the dispensers 10. Indeed, as illustrated, the transformer can be disposed remote from several restrooms in which the dispensers 10 are located. To provide power to the dispensers 10, the transformer 90 receives the input voltage supply and steps down the input voltage. This reduced voltage is then provided to the low voltage AC line 76.

The low voltage AC line 76 carry supply voltages to the dispensers 10 to power the dispensers 10. The low voltage AC line 76 can be routed to the dispensers through walls and/or ceilings. The supply lines can connect to adapters 20 within the dispensers 10 so that the adapters can appropriately alter the supply voltage for use by the dispensers. In one embodiment, the low voltage AC line 76 directly connect to adapters with corresponding connectors (e.g., male and female barrel jack connectors). Although FIG. 10 shows the dedicated low voltage AC line 76 for each dispenser 10, one low voltage AC line 76 can be used to power multiple dispensers 10. In addition, one or more dispensers 10 can be coupled to another dispenser 10 so that one dispenser 10 can provide power to another dispenser 10.

Figure 11:
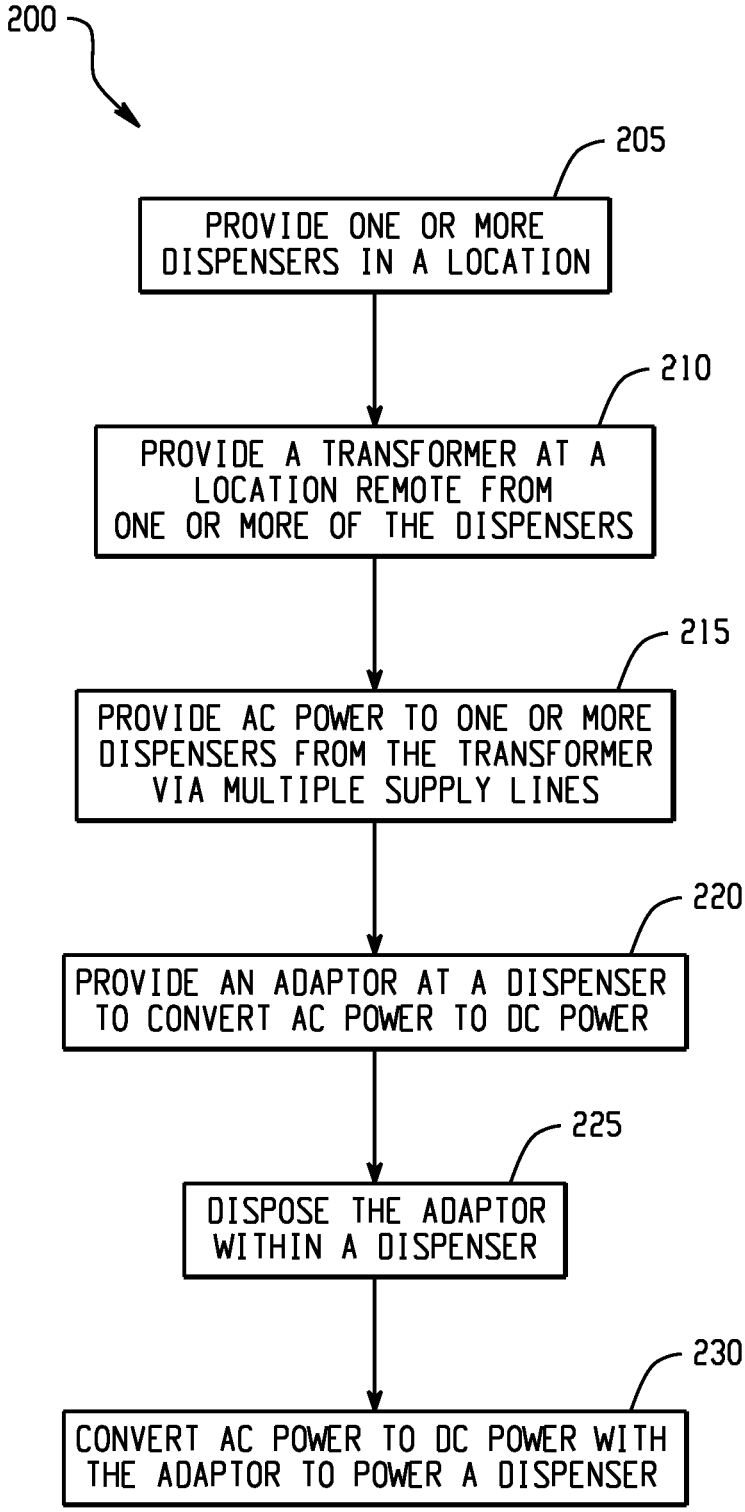
FIG. 11 illustrates a logical flow diagram of a method to power one or more dispensers in accordance with some embodiments of the present invention.

FIG. 11 illustrates a logical flow diagram of a method 200 to power one or more dispensers in accordance with some embodiments of the present invention. The method 200 can include installing one or more AC-to-DC adapters into existing dispensers to retrofit in use dispensers, installing a new dispenser network at a location, or combinations thereof. Those skilled in the art will understand that method 200 can be performed in various orders (including differently than illustrated in FIG. 11), additional actions can form part of method 200, and that some actions pictured in FIG. 11 are not necessary.

As shown in FIG. 11, the method 200 can initiate by providing one or more dispensers in a location 205. A location generally refers to a place where a user, supplier, or installer may desire to dispose one or more dispensers, and can include a building, a restaurant, a room, a school, and many other such places. The method 200 can also include providing a transformer at a location at 210. The transformer can receive a standard AC voltage supply (e.g., 120 VAC) and step down the standard AC voltage supply to a lower level AC voltage (e.g., 24 VAC). The lower level AC voltage can be provided to one or more dispensers via one or more supply lines at a location at 215.

The method 200 can further include providing one or more adapter devices to convert the lower level AC voltage to DC voltage at location 220. In one embodiment, the method 200 includes disposing an adapter within a dispenser placed at a location at 225. As shown at location 230, the adapter devices converts an AC supply voltage (e.g., 24 VAC) to a DC voltage (e.g., 6 VAC) according to method 200. The DC voltage can then be provided to power the one or more dispensers. The provided DC voltage can be used to power dispensing mechanisms such as sensors, motors, status monitoring systems, and user interface devices.

The method 200 can also include additional features. As an example, the method 200 can include accessing a low voltage terminal of a line voltage transformer and coupling the terminal to a power converter within an adapter to provide a low-level DC voltage. The method 200 may also include extending an electrical conductor (e.g., wire) between a transformer and a power converter. The method may further include running an electrical conductor through a building wall and through a back wall of a dispenser housing.

Advantageously, in embodiments, the adapter can be conveniently integrated as a removable unit-body into a battery compartment of an existing dispenser to achieve space saving and operational conveniences. In other embodiments, the AC-to-DC converter may be incorporated within the dispenser at the time of manufacture.

It is yet another advantage of embodiments of the present invention to provide a battery adapter system utilizing low voltage, which can be safely installed and routed by routine maintenance personnel, without the need for a skilled tradesman (e.g., an electrical contractor). In comparison to DC lines, the low voltage AC lines have substantially greater permissible run lengths. Furthermore, low voltage transformers are commonly available (e.g., in telephone systems, alarm systems and the like).

The embodiments of the present invention are not limited to the particular formulations, process steps, and materials disclosed herein as such formulations, process steps, and materials may vary somewhat. Moreover, the terminology employed herein is used for the purpose of describing exemplary embodiments only and the terminology is not intended to be limiting since the scope of the various embodiments of the present invention will be limited only by the appended claims and equivalents thereof.

Therefore, while certain embodiments of this disclosure have been described in detail with particular reference to exemplary embodiments, those skilled in the art will understand that variations and modifications can be effected within the scope of the disclosure as defined in the appended claims. Accordingly, the scope of the various embodiments of the present invention should not be limited to the above discussed embodiments, and should only be defined by the following claims and all equivalents.

What is claimed is:

1. A power system for a plurality of dispensers comprising:

an AC transformer to receive a line voltage and generate an output voltage of about 2 volts AC to about 50 volts AC;

a plurality of dispensers, each housing at least one electrical component operatively configured to dispense product through a dispensing aperture, each of the dispensers comprising a battery compartment so configured and dimensioned as to receive a plurality of conventional batteries disposed in a side-by-side arrangement, the battery compartment comprising two electrical connectors so configured and disposed as to make electrical contact with associated terminals of two of the plurality of conventional batteries when installed in the battery compartment; and a plurality of AC/DC power converters adapted to be disposed within the battery compartments such that at least one power converter is associated with each dispenser, the converters disposed in communication with the AC transformer such that the power converters receive the output voltage and provide a DC voltage to one or more electrical components housed within the respective dispensers;

wherein the AC transformer is a single AC transformer disposed in power communication with the plurality of power converters; and each of the plurality of power converters is so configured and dimensioned so as to be interchangeable with the plurality of conventional batteries within a respective one of the battery compartments, each of the plurality of power converters comprising two electrical connectors so configured and disposed as to make electrical contact with the two electrical connectors of the respective battery compartment, thereby providing for retrofit installation of power converters into battery compartments of in-use dispensers previously powered by a respective plurality of conventional batteries.

2. The power system of claim 1, the AC transformer being located at a location remote from at least one of the dispensers.

3. The power system of claim 1, the AC transformer being coupled to at least one of the dispensers via a plurality of lines, with each line passing through a rear housing wall of a corresponding dispenser.

4. The power system of claim 1, the dispensers being at least one of a sheet product dispenser, an air dispenser, a liquid dispenser, and a foam dispenser.

5. The power system of claim 1, the dispensers being paper dispensers provided in one or more restrooms and the AC transformer being provided in a room remote from the one or more restrooms.

6. The power system of claim 1, the at least one electrical component comprising a sensor and an electric motor, the sensor operatively configured to at least partially control operation of the motor.

7. The power system of claim 1, wherein the battery compartment is so configured and dimensioned as to receive a plurality of cylindrically shaped conventional batteries disposed in a side-by-side arrangement.

8. A power system for a plurality of paper dispensers comprising: an AC-to-AC transformer to receive a input AC voltage at a first voltage level and to provide an output AC voltage at a second voltage level;

a plurality of paper dispensers, each having a dispense roller powered by a roller motor, the roller motor being a DC motor;

a plurality of low voltage lines to carry the output AC voltage to the paper dispensers; and a plurality of AC-to-DC voltage converters each disposed within a respective one of the plurality of paper dispensers and coupled to at least one of the low voltage lines to receive the second voltage level, each AC-to-DC voltage converter operatively configured to convert the output AC voltage to an output DC voltage;

wherein each of the plurality of paper dispensers comprises a battery compartment so configured and dimensioned as to receive a plurality of conventional batteries disposed in a side-by-side arrangement, the battery compartment comprising two electrical connectors so configured and disposed as to make electrical contact with associated terminals of two of the plurality of conventional batteries when installed in the battery compartment;

wherein the AC-to-AC transformer is a single transformer disposed in power communication with the plurality of AC-to-DC voltage converters; and wherein each of the plurality of voltage converters is so configured and dimensioned so as to be interchangeable with the plurality of conventional batteries within a respective one of the battery compartments, each of the plurality of voltage converters comprising two electrical connectors so configured and disposed as to make electrical contact with the two electrical connectors of the respective battery compartment, thereby providing for retrofit installation of voltage converters into battery compartments of in-use dispensers previously powered by a respective plurality of conventional batteries.

9. The power system of claim 8, wherein the ratio of the first voltage level to the second voltage level is about 2 to about 25.

10. The power supply system of claim 8, the transformer being located remote from at least one of the paper dispensers such that an associated low voltage line ranges in length up to about 1000 feet.

11. The power supply system of claim 8, the paper dispenser comprising at least one other electrical component operatively configured to receive at least one of the output AC voltage or the output DC voltage for use in controlling operation of the paper dispenser.

12. The power supply system of claim 8, the at least one AC-to-DC voltage converter comprising an input terminal to receive the output AC voltage and an output terminal to provide the output DC voltage, the output terminal having electrical connections corresponding to electrical connections contained within the paper dispenser to receive electricity to operate the paper dispenser.

13. The power system of claim 8, wherein the battery compartment is so configured and dimensioned as to receive a plurality of cylindrically shaped conventional batteries disposed in a side-by-side arrangement.

14. A method to provide power to a plurality of dispensers, the method comprising:

providing a transformer operatively configured to receive an input voltage and to provide a supply voltage; and providing a plurality of voltage converters each to receive the supply voltage and to provide an output voltage, each output voltage being provided to a respective one of the plurality of dispensers to power the respective dispenser for dispensing operation and each voltage converter having a predetermined size such that the respective voltage converter can be removably disposed within a compartment housed within the respective dispenser;

wherein each respective compartment is so configured and dimensioned as to receive a plurality of conventional batteries disposed in a side-by-side arrangement, each respective compartment comprising two electrical connectors so configured and disposed as to make electrical contact with associated terminals of two of the plurality of conventional batteries when installed in the compartment;

wherein the transformer is a single transformer disposed in power communication with the plurality of voltage converters; and wherein each of the plurality of voltage converters is so configured and dimensioned so as to be interchangeable with the plurality of conventional batteries within a respective one of the compartments, each of the plurality of voltage converters comprising two electrical connectors so configured and disposed as to make electrical contact with the two electrical connectors of the respective compartment, thereby providing for retrofit installation of voltage converters into compartments of in-use dispensers previously powered by a respective plurality of conventional batteries.

15. The method of claim 14, further comprising providing one or more electrical conductive contacts on the voltage converter such that the voltage converter is disposed in electrical communication with the voltage converter and an electronic component of the dispenser.

16. The method of claim 14, further comprising providing at least one of paper, plastic, wiping material, sheet product, fragrance, tissue, liquid, and soap to be dispensed from the dispenser.

17. The method of claim 14, further comprising providing the voltage converter with a filtering circuit portion to filter the output voltage such that the output voltage can be provided to a sensor used to at least partially control dispensing operations of the dispenser.

18. The dispenser of claim 14, wherein the compartment housed within the dispenser is configured as a battery compartment for receiving at least one battery for operating the dispenser, and the voltage converter is configured to be interchangeable with the at least one battery in the battery compartment.

19. A dispenser comprising:

a dispenser housing having an inner chamber operatively configured to support a roll of paper and having a dispensing aperture;

a DC motor operatively configured to dispense paper from the roll of paper through the dispensing aperture;

a battery compartment so configured and dimensioned as to receive a plurality of conventional batteries disposed in a side-by-side arrangement, the battery compartment comprising two electrical connectors so configured and disposed as to make electrical contact with associated terminals of two of the plurality of conventional batteries when installed in the compartment; and a power converter so configured and dimensioned so as to be interchangeable with the plurality of conventional batteries within the battery compartment, the power converter comprising: an input terminal receiving an AC voltage of between 2 and 50 volts; an output terminal providing a DC voltage to the motor, the output terminal being so configured and disposed as to make electrical contact with the two electrical connectors of the battery compartment; and a converter circuit disposed between the input and output terminals;

wherein the battery compartment provides for retrofit installation of a power converter into the battery compartment of an in-use dispenser previously powered by a plurality of conventional batteries.

20. The dispenser network of claim 19, the AC voltage being provided by a transformer located remote from the dispenser, the transformer being configured to receive an input voltage of between approximately 110 VAC and approximate 230 VAC.

21. The dispenser network of claim 19, the power converter having an input terminal receiving the AC voltage and the converter circuit having an exposed output terminal contacting a battery terminal of the dispenser within said battery compartment, and the output terminal providing the DC voltage to the paper dispenser.

22. The dispenser of claim 19, wherein the battery compartment is so configured and dimensioned as to receive a plurality of cylindrically shaped conventional batteries disposed in a side-by-side arrangement.

* * * * *